US005518314A

United States Patent [19]

Kawafuchi et al.

[11] Patent Number: 5,518,314

[45] Date of Patent: May 21, 1996

[54] FLEXIBLE CONTAINER

[75] Inventors: Satoshi Kawafuchi; Minoru Ikeda; Hidemi Morishita, all of Okayama, Japan

[73] Assignee: Morishita Chemical Industry Co., Ltd., Okayama, Japan

[21] Appl. No.: 217,513

[22] Filed: Mar. 24, 1994

[30] Foreign Application Priority Data

Jun. 30, 1993 [JP] Japan ..... 5-187362

[51] Int. Cl.[6] ..... B65D 30/02

[52] U.S. Cl. ..... 383/22; 383/105; 383/117

[58] Field of Search ..... 383/17, 22, 24, 383/20, 105, 117

[56] References Cited

U.S. PATENT DOCUMENTS

| | | | |
|---|---|---|---|
| 4,362,199 | 12/1982 | Futerman | 383/24 X |
| 4,730,942 | 3/1988 | Fulcher | 383/24 X |

FOREIGN PATENT DOCUMENTS

| | | | |
|---|---|---|---|
| 0000838 | 2/1979 | European Pat. Off. | 383/17 |
| 0342012 | 11/1989 | European Pat. Off. | 383/17 |
| 0411683 | 2/1991 | European Pat. Off. | 383/17 |
| 2727441 | 5/1979 | Germany | 383/17 |
| 48-62246 | 8/1973 | Japan . | |
| 53-89578 | 8/1978 | Japan . | |
| 55-21917 | 2/1980 | Japan . | |
| 61-117186 | 7/1986 | Japan . | |
| 2224006 | 4/1990 | United Kingdom | 383/24 |

*Primary Examiner*—Jes F. Pascua
*Attorney, Agent, or Firm*—Lowe, Price, LeBlanc & Becker

[57] ABSTRACT

A flexible container in which a container body has a surrounding wall which is wove by a longitudinal thread and a lateral thread. As the longitudinal thread in a longitudinal strip range for stitching a hanging unit, a double-layer stretched tape yarn is used In which a first stretched tape yarn made of synthetic resin is covered by a second stretched tape yarn made of synthetic resin. As a longitudinal thread and a lateral thread other than a pair of strip reinforcing sections, the conventional stretched tape yarn made of synthetic resin is used. In the longitudinal strip area for stitching the hanging unit, the longitudinal thread having the double-layer stretched tape yarn is used, whereby it is possible to increase a count to reinforce the flexible container. The hanging unit has a base or proximal end thereof which is stitched to upper portions of the respective strip reinforcing sections by a sewing machine thread.

12 Claims, 4 Drawing Sheets

FLEXIBLE CONTAINER

BACKGROUND OF THE INVENTION

1. Field of the Invention

The present invention relates to a flexible container which is used to receive therein granular material or the like such as cement, agricultural products or the like, to transport or convey the same, or to store the same and, more particularly, to an attaching arrangement of hanging means.

2. Related Art and Prior Art Statement

In recent years, in order to make an attempt to rationalization of physical distribution, a demand of flexible containers of one-way type has increased more and more. Conventionally, a flexible container of this kind is arranged such that a tubular surrounding wall is formed by a foundation which is wove by a stretched tape yarn made of polyolefin synthetic resin such as polyethylene, polypropylene or the like. An upper lid or closure and a lower closure having an input port and an exhaust port, respectively, are mounted respectively on upper and lower portions of the surrounding wall, and strip hanging means is wove to the surrounding wall.

Such flexible container is foldable, and is light in weight, simple and low in cost. Accordingly, the flexible container has been used in quantity, particularly recently. The flexible container is hanged by the utilization of the hanging means, to thereby administer to the convenience of throwing-in, carriage or transportation and ejection of the contents.

However, in a case where the flexible container is handed down as described above, a large or high load is applied to a pair of stitched portions between the surrounding wall of the container body and the hanging means. However, since the surrounding wall of the container body is wove by the stretched tape yarn made of synthetic resin as described previously, the stitched portions of the hanging means with respect to the surrounding wall, particularly, lower edges of the hanging means in the surrounding wall cannot withstand the load, and are cut off. In the worst case, the container body or the contents therein falls or fall, and this is dangerous.

In view of the above, conventionally, in order to prevent the above-described danger, as has been described in Japanese Utility Model Laid-Open No. SHO 55-21917, the arrangement is such that a reinforcing belt in a peripheral direction (in the lateral direction) is stitched to the surrounding wall, and the hanging means is stitched to the reinforcing belt, or the hanging means is stitched to the surrounding wall, and the reinforcing belt in the peripheral direction is stitched to the surrounding wall from a location above the hanging means. Alternatively, as has been disclosed in Japanese Utility Model Laid-Open No. SHO 48-62246, Japanese Patent Laid-Open No. SHO 53-89578 and Japanese Utility Model Laid-Open No. SHO 61-117186, the stitched portion between the surrounding wall and the hanging means is reinforced in the form of a strip in the longitudinal direction, and the hanging means is stitched to the strip reinforced section. In the latter conventional example in which the container body per se is reinforced, generally, a first example is arranged such that a thread in a longitudinal direction the same as the homespun thread of the surrounding wall of the container body is used to weave the hanging means with density higher than the container body to reinforce the hanging means, and a second example is arranged such that a reinforcing thread in the longitudinal direction, which is different in quality from the homespun thread of the surrounding wall of the container body and which is thicker than the same or which is superior in tensile strength is used to weave the hanging means with density substantially the same as that of a principle portion of the surrounding wall of the container body, or with count more than the latter to reinforce the hanging means.

Of the conventional flexible containers, if the reinforcing belt in the peripheral direction (in the lateral direction) as is in the former is used, the vertical width of the reinforcing belt must be widened in order to increase the area of the attaching portion of the hanging means. However, if the width of the reinforcing belt is widened, the weight increases. Not only the flexible container is raised in cost, but also, in a case where the flexible container is empty, it is difficult to fold the flexible container flat. Thus, the flexible characteristic is lost. Moreover, when the contents are filled, a folded habit or way is difficult to be broken off, and it becomes difficult to envelope the flexible container. Accordingly, it cannot but reduce the width of the reinforcing belt. As a result, the area of the attaching portion of the hanging means is reduced, and this is inferior to attaching strength.

Meanwhile, with the arrangement that the strip reinforcing section is formed on the surrounding wall per se of the container body as in the latter, the outward surface of the stretched tape yarn or the like rubs against a guide, a reed and a shuttle of a weaving machine upon weaving, and weaving degradation or deterioration of the order of 10–20% occurs. For this reason, the flexible container is inferior to the strength of the strip reinforcing section, and reliability is inferior. Furthermore, with the arrangement In which the longitudinal thread or warp thread is wove at high density like the first example, there is a limit in high densification, that is, in strength. Further, in the second example, in a case where only a reinforcing thread different in quality from the homespun thread is used at the strip reinforcing section, difficulty is accompanied in weaving working or operation by a difference in tensile strength, elastic modulus and the like from the drawn tape yarn that is the homespun thread. Even if the flexible container can be wove, not only the flexible container is inferior in outer appearance, such as, particularly, the boundary between the surrounding wall principal portion and the strip reinforcing section is heaved or flapped, or the like, but also, even if the reinforcing thread is superior In tensile strength, the reinforcing thread is broken from a portion weak in tensile strength because the reinforcing thread is different in tensile strength, elastic modulus, ductility and the like from the homespun thread. Alternatively, the reinforcing thread begins to be torn off. Thus, the characteristics of the reinforcing thread cannot be improved or be employed efficiently as compared with the tensile strength of the thread per se. Furthermore, when the hanging means is stitched to the strip reinforcing section, in a case where the reinforcing thread of the strip reinforcing section is different in quality from the homespun thread, or in a case where the reinforcing thread is thick in wall than the homespun thread even if the reinforcing thread is the same in quality as the homespun thread, a sewing-machine needle and a sewing-machine thread are difficult to pass through the reinforming thread. Thus, sewing deterioration or degradation of the order of 10–20% occurs due to heat generation of the sewing-machine needle, cracking of the reinforcing thread, or the like. After all, it is impossible to produce a flexible container which is superior in tensile strength. Moreover, in a case where the reinforcing thread is thick in diameter than the homespun thread, not only the weight increases, but also the flexible container is inferior in flexibility of the strip reinforcing section. Similarly to the conventional example which uses the reinforcing belt, it is difficult to fold up the flexible container flat in a case of empty. The characteristic of the flexible container is lost. When the contents are filled, it is difficult to break a folded habit, and it becomes difficult to develop the flexible container. Further, in a case where the reinforcing thread different in quality from the homespun thread is used, if an attempt is made to laminate a film made of synthetic resin to one side or both sides of the woven fabric, it is impossible to heat-melt or heat-fuse the synthetic resins different in quality from each other, to each other. Accordingly, there are problems that it is impossible to use the flexible container in a use in which waterproofness is required, and the like.

OBJECTS AND SUMMARY OF THE INVENTION

The invention intends to solve the above-discussed conventional problems, and it is an object of the invention to provide a flexible container in which a warp thread in a strip portion in a longitudinal direction in which hanging means is attached increases in count easily, weaving deterioration or degradation of the warp thread is suppressed or restrained to reinforce the flexible container, and it is possible to improve the attaching strength of the hanging means and, accordingly, it is prevented from occurring that hanging means is demounted and a bag is broken, so that generation of danger can be prevented from occurring.

It is an another object of the invention to provide a flexible container in which resiliency or elasticity of a strip reinforcing section can be maintained and, accordingly, it is possible to fold the flexible container flat.

It is an other object of the invention to provide a flexible container in which, when contents are filled, the flexible container is easy to be developed so that it is possible to easily perform filling operation.

It is a still another object of the invention to provide a flexible container in which an attempt is made to reduce the weight of the flexible container, to improve convenience or facility of handling, and the like.

It is a further object of the invention to provide a flexible container in which a thread the same in quality as threads other than a thread which is used in a pair of strip reinforcing sections are used in the thread which is used in the strip reinforcing sections, whereby whole elongation is substantially uniformized, to thereby enable flapping in or at a boundary between the strip reinforcing sections and a surrounding wall principal portion to be restrained.

It is an object of the invention to provide a flexible container in which a tensile strength can be improved as the whole container and, accordingly, an outer appearance can be improved.

It is an another object of the invention to provide a flexible container in which it is possible to further effectively prevent that hanging means is detached, and a bag is broken.

It is an other object of the invention to provide a flexible container in which a film made of synthetic resin can reliably be heat-melted to the whole surface of a surrounding wall, as occasion demands and, accordingly, it is possible to cope with a case where waterproofness is required.

It is a further object of the invention to provide a flexible container in which management of a material (stretched tape yarn only) is easy so that, as a result, an attempt can be made to reduce the cost.

According to the present invention, there is provided a flexible container in which a container body has a surrounding wall which is wove by a warp thread and a weft thread which consist of a stretched tape yarn made of synthetic resin, in which a strip region or area in a longitudinal direction for stitching hanging means in the surrounding wall is reinforced by the use of a double-layer stretched tape yarn which consists of a first stretched tape yarn and a second stretched tape yarn which covers the first stretched tape yarn, in at least a part of the warp thread, and in which hanging means is stitched to the strip reinforcing section.

Furthermore, in technical means described above, the first and second stretched tape yarns which cooperate with each other to form the double-layer stretched tape yarn may be formed by polyolefin synthetic resin which is the same in quality as other stretched tape yarns.

The container body may be provided therein with an input port and an exhaust port respectively at an upper portion and a lower portion of the container body. The input port and the exhaust port may be used as a single port. Further, the container body may be cylindrical in shape, or rectangular in shape. Moreover, the arrangement may be such that the surrounding wall of the container body is tubular in shape of foundation, and an end thereof is stitched. Alternatively, the surrounding wall of the container body may be formed by a tubular woven fabric. Furthermore, it may suitably select the arrangement of the strip reinforcing section and the hanging means.

With the above arrangement of the invention, the strip area in the longitudinal direction, for stitching the hanging means in the surrounding wall is reinforced by the use of the double-layer stretched tape yarn which comprises the first stretched tape yarn made of synthetic resin and the second stretched tape yarn made of synthetic resin, which covers the first stretched tape yarn, in at least the part of the longitudinal yarn or warp yarn. Accordingly, it is possible to easily increase the count of the warp thread. Further, the first stretched tape yarn which is covered with the second stretched tape yarn can prevent rubbing with respect to a guide, a reed and a shuttle of a weaving machine. The weaving deterioration or degradation can be restrained to reinforce the first stretched tape yarn. Thus, it is possible to improve the attaching strength of the hanging means. Furthermore, since each of the strip reinforcing sections increases the count of the stretched tape yarn to reinforce the same, resiliency or elasticity of each of the strip reinforcing sections can be maintained. Moreover, since the whole surrounding wall is wove only by the stretched tape yarn, an attempt can be made to reduce the weight or the flexible container.

Further, by the fact that the stretched tape yarn the same In material as the other tape yarns is used in the double-layer stretched tape yarn which is used in each of the strip reinforcing sections, the whole elongation is substantially uniformized. Thus, it is possible to restrain flapping at the boundary between the strip reinforcing sections and the surrounding wall principal portion, and It is possible to improve the tensile strength as the whole container. Moreover, by the fact that the same material is used for the stretched tape yarn of the whole surrounding wall, a film made of synthetic resin the same in quality as the stretched tape yarn can be used as occasion demands, and can securely or reliably be heat-fused to the entire or whole surface of the surrounding wall. Furthermore, by the fact that the stretched tape yarn of a single kind or type is used, management of the quality, stock and the like are facilitated.

DETAILED DESCRIPTION OF THE PREFERRED EMBODIMENTS

An embodiment of the invention will hereunder be described with reference to the drawings.

Figure 1:
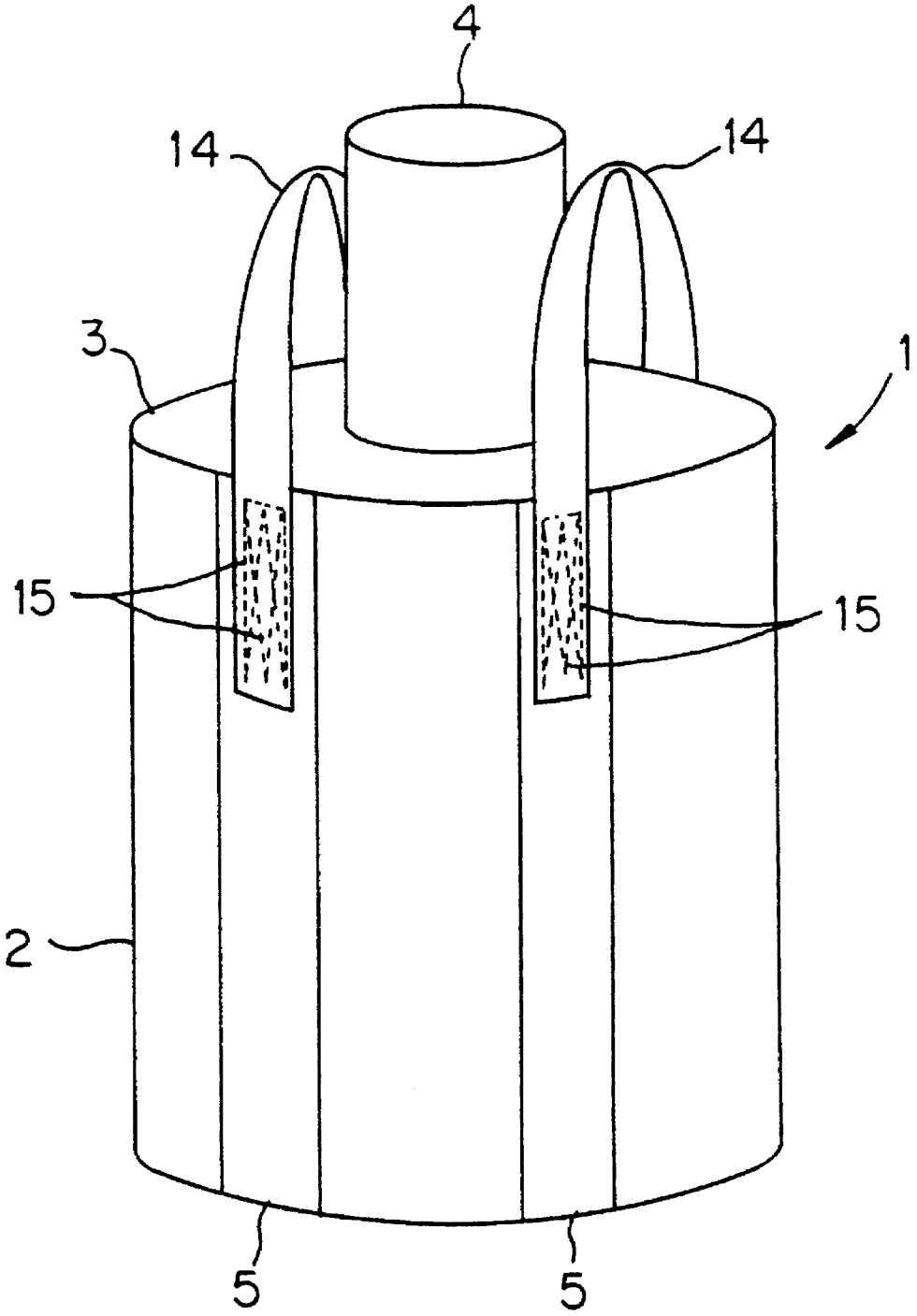
FIG. 1 is a schematic perspective view showing an embodiment of a flexible container according to the invention.
Figure 2:
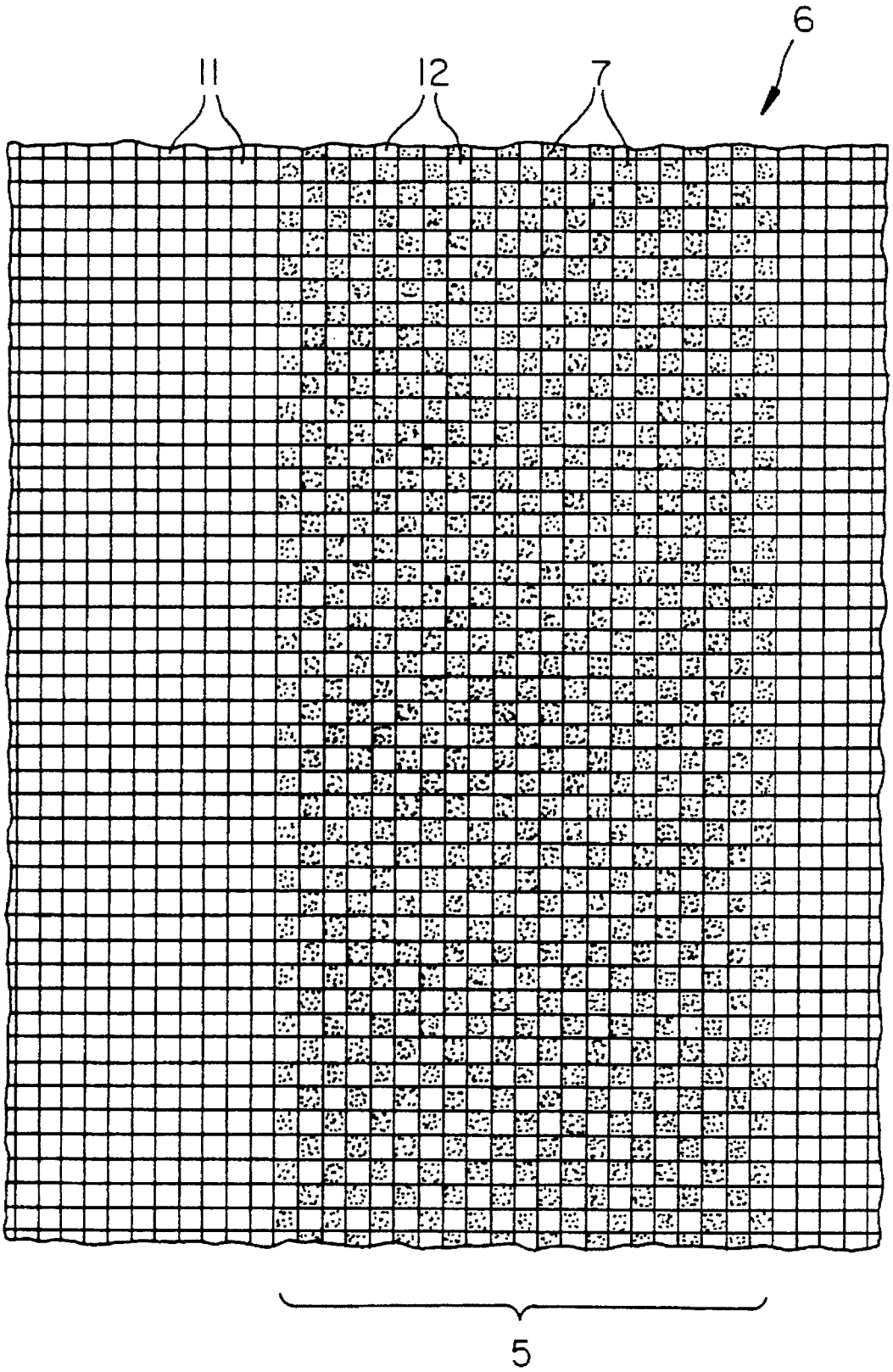
FIG. 2 is a partially enlarged view showing an example of a foundation which is used in the flexible container.
Figure 3:
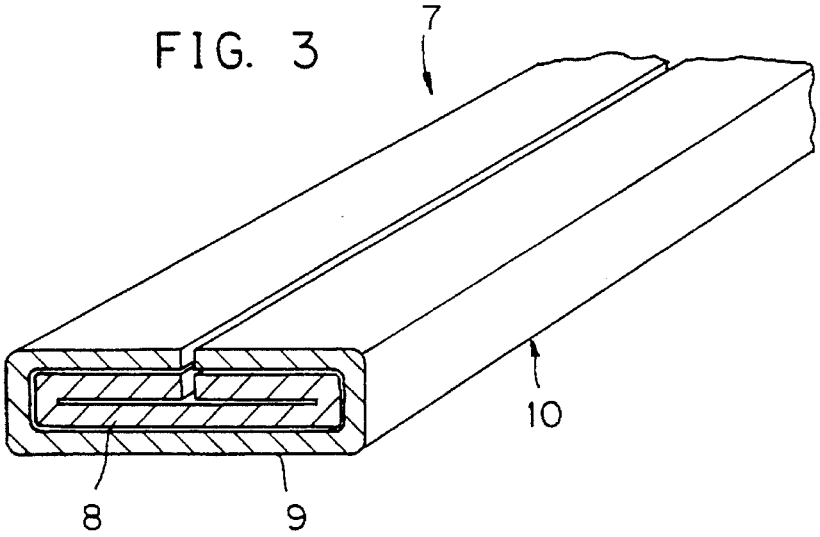
FIG. 3 is a partially enlarged perspective view showing an example of a double-layer stretched tape yarn which is used in a warp thread in each of a pair of strip reinforcing sections of the flexible container.
Figure 4:
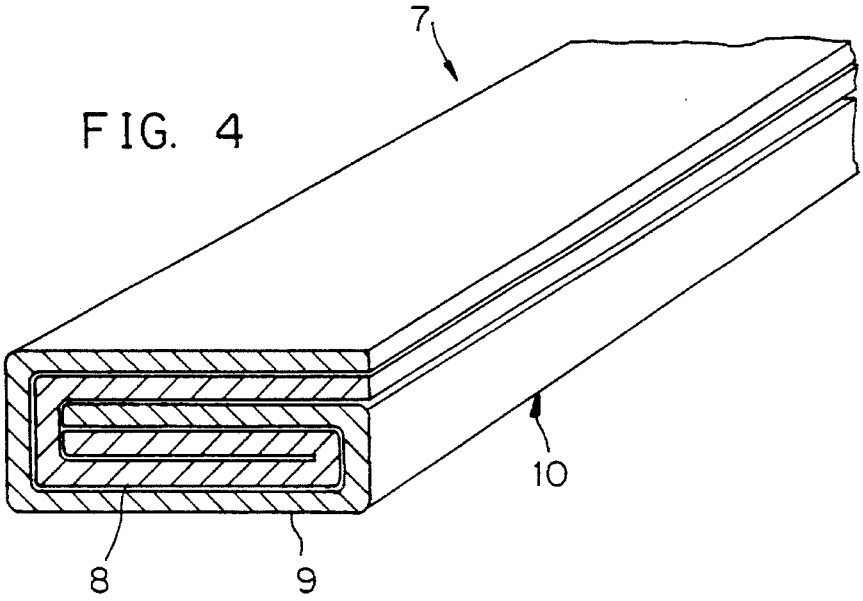
FIG. 4 is a partially enlarged perspective view showing an another example of the double-layer stretched tape yarn which is used in the warp thread in each of the strip reinforcing sections of the flexible container.

FIG. 1 is a schematic perspective view showing an embodiment of a flexible container according to the invention. FIG. 2 is a partially enlarged view showing an example of a foundation which is used in the flexible container. FIGS. 3 and 4 are partially enlarged perspective views showing an example of a double-layer stretched tape yarn which is used in a warp thread in each of a pair of strip reinforcing sections of the flexible container. FIGS. 5, 6, 7 and 8 are partially enlarged perspective views showing an example of a stretched tape yarn (flat yarn) which is used to a warp and a weft thread, other than the strip reinforcing sections of the flexible container.

As shown in FIG. 1, the flexible container has a container body 1 which is arranged such that an upper lid or closure 8 is mounted on an upper portion of a surrounding wall 2 by means of stitching or the like. An input port 4 is mounted on the upper closure 3 by means of stitching or the like. A lower closure (omitted from illustration) is mounted on a lower portion of the surrounding wall 2 by means of stitching or the like. An exhaust port (omitted from illustration) is mounted on the lower closure by means of stitching or the like.

As shown in FIGS. 1 and 2, totally two pairs of longitudinal strip reinforcing sections 5 for stitching hanging means are formed, with each pair corresponding to each other, on the surrounding wall 2 over the entire length from an upper end to a lower end thereof. A foundation 6 which forms the surrounding wall 2 is wove by a stretched tape yarn made of polyolefin synthetic resin such as polyethylene, polypropylene or the like.

The details of the foundation 6 will be described. A double-layer stretched tape yarn 10 having a first stretched tape yarn 8 and a second stretched tape yarn 9 as shown in FIG. 3 or FIG. 4 is used in each of longitudinal threads, i.e., warp threads 7 of the strip reinforcing section 5. A single stretched tape yarn 13 shown in FIGS. 5, 6, 7 or 8 is used in other each of warp threads 11 and each of lateral threads i.e., weft threads 12.

The double-layer stretched tape yarn 10 shown in FIG. 3 is such that a pair of films made of resin which are polyolefin and which are the same in material as each other are put one upon another and are cut in an elongated manner with a desired width. The double-layer stretched tape yarn 10 passes through a guide with the pair put one upon another. Longitudinal edges on both sides are folded back to the same side. End surfaces of the respective edges on both sides are butted against each other, or are moved toward each other or approach each other so as to be butted against each other. Under a condition bent or folded in this manner, the double-layer stretched tape yarn 10 is heated under 90° C.–180° C. and is drawn 4–10 times in a taking-over direction. An outer surface of the first stretched tape yarn 8 is covered by the second stretched tape yarn 9 without being adhered to each other. Alternatively, a polyolefin resin film is cut in an elongated manner with a desired width, and is drawn similarly to the above. The two tape yarns 8 and 9 the same in material as each other after being drawn are put one upon another. The two tape yarns 8 and 9 pass through the guide under this condition. Longitudinal edges on both sides are folded back toward the same side so that end surfaces of the respective longitudinal edges on both sides are butted against each other. Alternatively, the end surfaces of the respective longitudinal edges approach each other such that they are butted against each other, and the tape yarns 8 and 9 are heat-set. The outer surface of the first stretched tape yarn 8 is covered by the second stretched tape yarn 9 without being bonded or adhered to each other.

The double-layer stretched tape yarn 10 shown in FIG. 4 is arranged such that two polyolefin films which are made of resin and which are the same in quality as each other, are put one upon another, are cut in an elongated manner with a desired width, and pass through the guide under a condition in which two are put one upon each other. Longitudinal edges on one side are folded back. Longitudinal edges on the other side are folded back so as to be put upon the longitudinal edges on the one side. Under such a condition folded back, the double-layer stretched tape yarn 10 is drawn in a manner similar to that described above. The outer surface of the first stretched tape yarn 8 is covered by the second stretched tape yarn 9 without being adhered to each other. Alternatively, a polyolefin resin film is cut in an elongated manner with a desired width and is drawn similar to the above. The pair of tape yarns 8 and 9 of the same material after being drawn are put one upon another. Under this condition, the pair of tape yarns 8 and 9 pass through the guide. A longitudinal edge on the one side is folded back. A longitudinal edge on the other side is folded back so as to be put upon the longitudinal edge on one side and is heat-set. The outer surface of the first stretched tape yarn 8 is covered by the second stretched tape yarn 9 without being adhered to each other.

Figure 5:
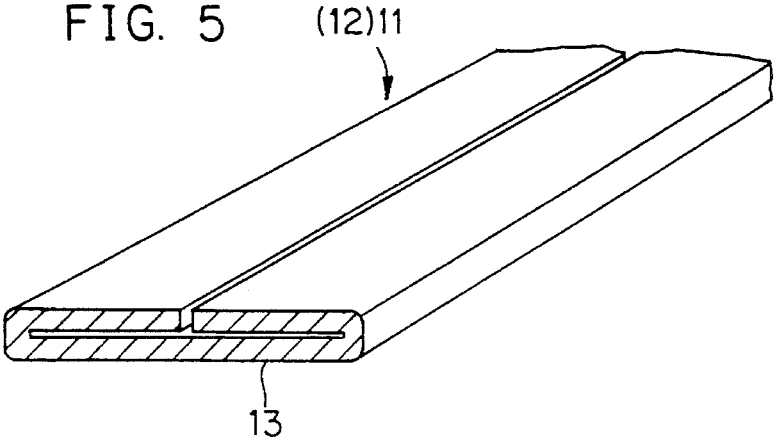
FIG. 5 is a partially enlarged perspective view showing an example of a stretched tape yarn which is used In the warp thread and a weft thread other than the strip reinforcing sections of the flexible container.

The stretched tape yarn 13 illustrated in FIG. 5 is arranged such that a film made of polyolefin resin is cut in an elongated manner with a desired width, and passes through the guide, and longitudinal edges on both sides are folded back toward the same side so that end surfaces of longitudinal edges on both sides are butted against each other, or approach each other so as to be butted against each other. Under a condition folded in this manner, the film is drawn similarly to the above. Alternatively, a polyolefin resin film is cut in an elongated manner with a desired width and is drawn similarly to the above, and passes through the guide. Longitudinal edges on both sides are folded back toward the same side. End surfaces of the respective longitudinal edges on both sides are butted against each other, or approach each other so as to be butted against each other. Thus, the polyolefin resin film is heat-set.

Figure 6:
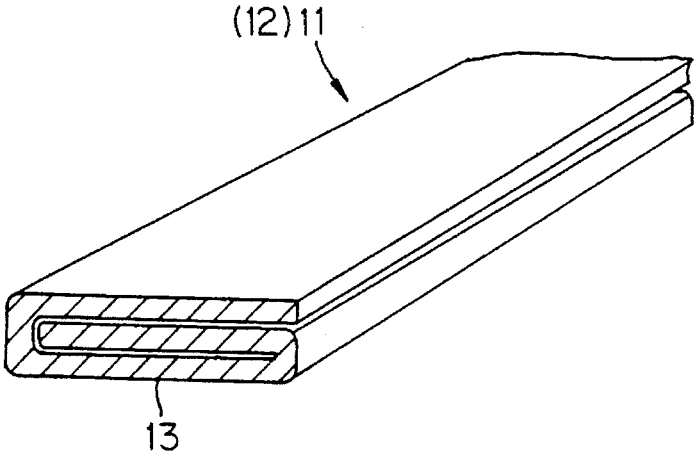
FIG. 6 is a partially enlarged perspective view showing an another example of a stretched tape yarn which is used in the warp thread and the weft thread other than the strip reinforcing sections of the flexible container.

The stretched tape yarn 18 illustrated in FIG. 6 is arranged as follows. That is, a film made of polyolefin resin is cut in an elongated manner with a desired width, and passes through the guide. A longitudinal edge on one side is folded back. Then, a longitudinal edge on the other side is folded back so as to be put upon the longitudinal edge on one side. Under a condition folded in this manner, the tape yarn 13 is drawn similarly to the above. Alternatively, a polyolefin resin film is cut in an elongated manner with a desired width, and is drawn similarly to the above. The polyolefin resin film passes through the guide. A longitudinal edge on one side is folded back. Then, a longitudinal edge on the other side is folded back so as to be put upon the longitudinal edge on one side, and is heat-set.

Figure 7:
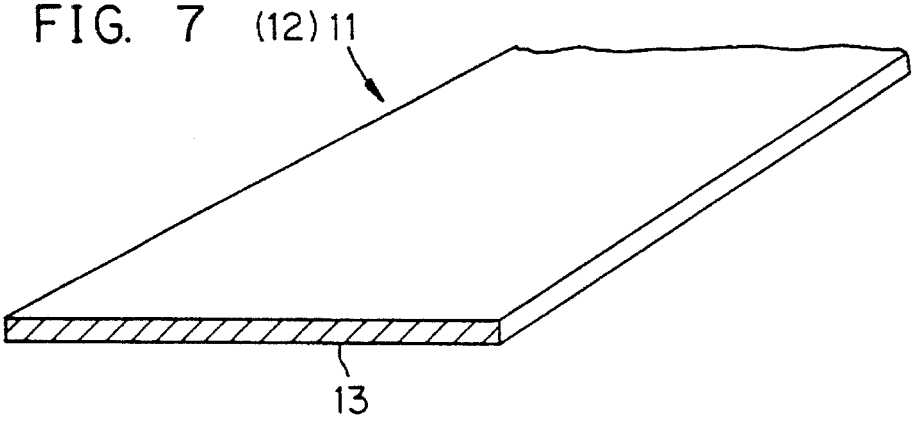
FIG. 7 is a partially enlarged perspective view showing an other example of the stretched tape yarn which Is used in the warp thread and the weft thread other than the strip reinforcing sections of the flexible container.
Figure 8:
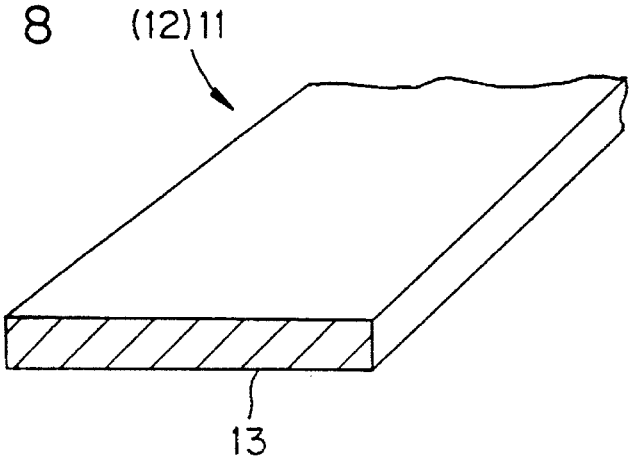
FIG. 8 is a partially enlarged perspective view showing a still further example of a stretched tape yarn which Is used in the warp thread and the weft thread other than the strip reinforcing sections of the flexible container.

The stretched tape yarn 13 shown FIG. 7 or FIG. 8 has conventionally been used. In a case where a film made of polyolefin resin is thin, the stretched tape yarn 13 is cut in an elongated manner into a yarn wide in width, and in a case where a film made of polyolefin resin is thick, the stretched tape yarn 13 is cut in an elongated manner into a yarn narrow in width. The tape is drawn similarly to the above.

As the stretched tape yarns 8, 9 and 13, it is desirable that a yarn is 1500 denier, and has tensile strength equal to or more than 4 g/d, tensile ductility equal to or more than 15% under a condition in which the room temperature is 20° C., and a longitudinal tearing or breaking strength which is equal to or more than 90 g/mm.

The stretched tape yarn is wove by the use of the stretched tape yarn 13 of 3–6 mm in width shown in any one of FIGS. 5 to 8 as the warp thread 11 of a portion except for the strip reinforcing section 5, the stretched tape yarn 13 of 3–6 mm in width shown in any one of FIGS. 5 to 8 as the weft thread 12, and the double-layer stretched tape yarn 10 of the order of 2–4 mm in width shown in FIGS. 3 or 4 as the warp thread 7 of the strip reinforcing section 5. The surrounding wall 2 is arranged. The strip reinforcing section 5 is arranged such that the double-layer stretched tape yarn 10 is used as the warp thread 7, whereby the count increases. Thus, the strip reinforcing section 5 is reinforced.

At this time, the warp thread 7 of the strip reinforcing section 5 uses the double-layer stretched tape yarn 10 in which the first stretched tape yarn 8 is covered by the second stretched tape yarn 9 as described previously. Accordingly, since the first stretched tape yarn 8 does not rub against a guide, a reed and a shuttle of a weaving machine, there is no fear that weaving deterioration or degradation occurs. Thus, it is possible to restrain the weaving deterioration within 10%. Further, since the strip reinforcing section 5 is wove only by the thin stretched tape yarns 8, 9 and 13, it is possible to maintain resiliency or elasticity. By the fact that the double-layer stretched tape yarn 10 and the stretched tape yarn 13 are formed by the same material as descried above, it is possible to obtain or produce substantially the same material value. Accordingly, if the double-layer stretched tape yarn 10 is used to bring the count of the warp thread 7 of the strip reinforcing section 5 to, for example, 1.4 times, this portion is less in weaving deterioration as described above. Accordingly, it is possible to produce the tensile strength of 1.4 times as compared with the count. Moreover, by the fact that the stretched tape yarns 10 and 13 are formed by the same material, it is possible to substantially uniformize the whole elongation, and to restrain flapping at the boundary between the strip reinforcing section 5 and the principal portion of the surrounding wall 2. In a case where waterproofness is required, the foundation 6 which forms the surrounding wall 2 is arranged such that a film made of polyolefin resin such as polyethylene, polypropylene or the like is laminated upon either one of a front surface and a rear surface of the woven fabric or upon both surfaces thereof. At this time, the stretched tape yarns 10 and 13 are formed by the same material as described above, and flapping is restrained, whereby it is reliably possible to perform heat-melting or heat-fusion over the total surface by the use of a film the same in material as the stretched tape yarns 10 and 13.

Hanging means 14 in the form of a belt illustrated in FIG. 1 is arranged similarly to the strip reinforcing section 5 of the foundation 6, or the hanging means 14 is wove as only the double-layer stretched tape yarn 10 serving as a warp thread and a weft thread, or the hanging means 14 is formed by a synthetic fiber, such as by weaving or the like, into the form of a strip having a desired strength, and a pair of hanging means are used. Each of the hanging means 14 is curved at a central portion thereof so that both sides are put upon the outer surface of the upper portion of the strip reinforcing section 5 of the surrounding wall 2, and the hanging means 14 is stitched to the strip reinforcing sections 5 by means of sewing machine threads 15, respectively. In this manner, when the hanging means 14 is stitched to the strip reinforcing sections 5, since the strip reinforcing sections 5 are formed only by thin stretched tape yarns, a sewing machine needle and a sewing machine thread easily pass through the reinforcing sections 5. Thus, it is possible to restrain heat generation of the sewing machine needle, and it is possible to prevent cracking and the like of the stretched tape yarn to suppress or restrain sewing deterioration to a value equal to or less than 10%. It is possible to suitably select a stitching area between the hanging means 14 and the strip reinforcing sections 5 in accordance with the use, the object and the like thereof. It is also possible to widen the stitching area in a longitudinal direction. It is unnecessary or not required to widen the lateral widths of the respective strip reinforcing sections 5 more than the necessity.

The using point of the flexible container arranged as described above will hereunder be described.

The pair of hanging means 14 are hooked to a hook or the like of a crane, and are retained to a hanging-down condition, and pulverulence or the like is thrown into the container body 1 from the input port 4. After throwing in, the input port 4 is closed. The container body 1 is moved downwardly for storage or the like to a desirable location. In order to carry the flexible container which houses the pulverulence or the like in this manner, the pair of hanging means 14 are hooked to the hook or the like of the crane and is hanged down or suspended. However, since the attaching portions of the respective hanging means 14 are mounted on the strip reinforcing sections 5 of the surrounding wall 2 of the container body 1, even if a large or heavy load is applied to the attaching portions, it is possible to prevent that the attaching portions are demounted, and the bag is broken.

Accordingly, it is possible to prevent such dangers that the contents fall down, the container body 1 falls down together with the contents, and the like.

In connection with the above, the strip reinforcing sections 5 may be provided in extension on a bottom of the container body 1. Further, the double-layer stretched tape yarn 10 may not be used for all the longitudinal threads of the strip reinforcing sections 5. The double-layer stretched tape yarn 10 may suitably be used in adjoining combination with the stretched tape yarn 13 which has conventionally been used as shown in FIGS. 5 to 7. Moreover, the first stretched tape yarn 8 and the second stretched tape yarn 9 of the double-layer stretched tape yarn 10 may not be the same in material as each other, but material superior in wear resistance may be used in the second stretched tape yarn 9 which covers the first stretched tape yarn 8, for example. Furthermore, in the embodiment described above, the double-layer stretched tape yarn 10 is arranged such that the first stretched tape yarn 8 Which is covered by the second stretched tape yarn 9 is a single, but the first stretched tape yarn 8 may be plural more than two. Moreover, the hanging means 14 may of a type in which the hanging means has annular portions at forward ends thereof, respectively, and is used such that a rope is inserted through the annular portions. Besides, the invention may variously be modified within a scope without departing the fundamental technical idea.

As described above, according to the invention, the longitudinal strip area for stitching the hanging means in the surrounding wall is reinforced by the use of the double-layer stretched tape yarn which has the first stretched tape yarn made of synthetic resin, and the second stretched tape yarn made of synthetic resin for covering the first stretched tape yarn in at least the portion of the longitudinal thread. Accordingly, it is possible to easily increase the count of the longitudinal thread. Furthermore, the first stretched tape yarn which is covered by the second stretched tape yarn is prevented from rubbing against the guide, the reed and the shuttle of the weaving machine. The weaving deterioration or degradation is restrained so that it is possible to reinforce the first stretched tape yarn. Thus, it is possible to improve the attaching strength of the hanging means. Accordingly, it is possible to prevent the hanging means from being demounted and the bag from being broken to prevent danger to be generated. Moreover, since the strip reinforcing sections are reinforced by an increase of the count of the stretched tape yarn, it is possible to maintain flexibility of each of the strip reinforcing sections. Accordingly, it is possible to fold the flexible container flat. Furthermore, it is possible to easily perform filling operation by the fact that, when the contents are filled, the flexible container is easy to be developed. Further, since the whole surrounding wall is wove only by the stretched flat yarn, an attempt can be made to reduce the weight. Accordingly, it is possible to improve convenience or facility or the like of the handling.

Moreover, yarn which is the same in quality or material as the other stretched tape yarn is used in the double-layer tape yarn which is used in each of the strip reinforcing sections, whereby the elongation of the entirety is substantially uniformized. Thus, it is possible to restrain flapping at the boundaries between the strip reinforcing sections and the principle portion of the surrounding wall, and it is possible to improve the tensile strength as the whole container. Accordingly, it is possible to improve the outer appearance, and it is possible to prevent the hanging means from being demounted and the bag from being broken further more effectively. Furthermore, by the fact that yarns which are the same in material as each other are used in the stretched tape yarn of all the surrounding wall, it is possible to use the film made of synthetic resin of the same material as the stretched tape yarn, as occasion demands, to securely or reliably heat-fuse the film on the entire surface of the surrounding wall. Accordingly, it is possible to cope with a case where waterproofness is required. Further, by the fact that the stretched tape yarn of a single kind or type is used, it is possible to facilitate management of quality, stock and the like to make an attempt to reduce the cost, as a result.

What is claimed is:

1. A flexible container comprising:

a container body having a surrounding wall woven of longitudinal threads and lateral threads, said longitudinal and lateral threads being a stretched tape yarn of synthetic resin, said surrounding wall including a longitudinal strip area for stitching to hanging means, said longitudinal strip area including, at least in longitudinal yarn thereof, a double-layer stretched tape yarn having a first stretched tape yarn and a second stretched tape yarn covering said first stretched tape yarn, wherein said hanging means is stitched to said longitudinal strip area.

2. The flexible container recited in claim 1, wherein substantially all longitudinal threads of said longitudinal strip area of said surrounding wall comprise said double-layer stretched tape yarn.

3. The flexible container recited in claim 1, wherein said double-layer stretched tape yarn of said longitudinal strip area of said surrounding wall comprise threads of a same synthetic resin material as said lateral threads of said surrounding wall.

4. The flexible container recited in claim 3, wherein said double-layer stretched tape yarn of said longitudinal strip area of said surrounding wall comprise threads of a same synthetic resin material as longitudinal threads of said surrounding wall other than the longitudinal threads of said longitudinal strip area.

5. The flexible container recited in claim 4, wherein said longitudinal strip has a substantially belt shaped reinforcing strip including a belt of longitudinal threads comprising said double-layer stretched tape yarn.

6. The flexible container recited in claim 5, wherein said hanging means comprises a longitudinal belt shaped structure including in longitudinal yarn thereof, a double-layer stretched tape yarn having a first stretched tape yarn and a second stretched tape yarn covering said first stretched tape yarn.

7. The flexible container recited in claim 6, wherein said substantially all longitudinal threads of said hanging means comprise said double-layer stretched tape yarn.

8. The flexible container recited in claim 1, wherein said hanging means comprises a longitudinal belt shaped structure including in longitudinal yarn thereof, a double-layer stretched tape yarn having a first stretched tape yarn and a second stretched tape yarn covering said first stretched tape yarn.

9. A flexible container comprising:

a container body having a surrounding wall woven of longitudinal threads and lateral threads, said longitudinal and lateral threads being a stretched tape yarn of synthetic resin, said surrounding wall including a longitudinal strip area for stitching to hanging means, said hanging means including, at least in longitudinal yarn thereof, a double-layer stretched tape yarn having a first stretched tape yarn and a second stretched tape yarn covering said first stretched tape yarn, wherein said hanging means is stitched to said longitudinal strip area.

10. The flexible container recited in claim 9, wherein said hanging means comprises a longitudinal belt shaped structure, and said double-layer stretched tape yarn of said hanging means comprises threads of a same synthetic resin material as said lateral threads of said surrounding wall.

11. The flexible container recited in claim 10, said hanging means further including, in lateral yarn thereof, said double-layer stretched tape yarn.

12. The flexible container recited in claim 9, said hanging means further including, in lateral yarn thereof, said double-layer stretched tape yarn.

* * * * *